United States Patent [19]

Swift

[11] 4,207,824

[45] Jun. 17, 1980

[54] MACHINES FOR THE MANUFACTURE OF FOOTWEAR

[75] Inventor: John Swift, Rossendale, England

[73] Assignee: Lambert Howarth & Sons Limited, Burnley, England

[21] Appl. No.: 895,059

[22] Filed: Apr. 10, 1978

[51] Int. Cl.[2] ..... D05B 15/00; D05B 23/00

[52] U.S. Cl. ..... 112/49; 112/121

[58] Field of Search ..... 112/79.5, 80, 169, 121, 112/49, 28, 3, 9, 10, 21, 162, 262, 53, 54; 12/103, 142 MO

[56] References Cited

U.S. PATENT DOCUMENTS

| | | | |
|---|---|---|---|
| 2,887,966 | 5/1959 | Felton | 112/79.5 |
| 3,225,724 | 12/1965 | Klassert | 112/79.5 |
| 3,512,198 | 5/1970 | Goldman | 12/103 |
| 3,538,527 | 11/1970 | Ioannilli | 12/142 MO |
| 3,913,508 | 10/1975 | Boser | 112/221 |

FOREIGN PATENT DOCUMENTS

| | | | |
|---|---|---|---|
| 1485416 | 6/1969 | Fed. Rep. of Germany | 112/79.5 |

*Primary Examiner*—Patrick D. Lawson

*Attorney, Agent, or Firm*—Norris & Bateman

[57] ABSTRACT

The invention comprises a method of and machine for stitching a thong to an upper in a machine for the manufacture of footwear in which the vamp is sewn to the upper by leather thongs, in which a barbed needle on a ram reciprocating in a fluid operated cylinder is passed through preformed pairs of shaped holes in the material to be thonged, applying a thonging thread to the needle and applying fluid to one end of the cylinder to draw the needle and the thonging thread through the vamp and the upper, withdrawing the needle and moving the material to receive the needle through a succeeding pair of holes on the material and applying fluid to the opposite end side of the ram and re-passing the needle and thonging thread through the vamp and upper for succeeding stitches, an air line being connected to each end of the cylinder with a control valve to regulate the air flow.

3 Claims, 5 Drawing Figures

MACHINES FOR THE MANUFACTURE OF FOOTWEAR

This invention relates to improvements in the manufacture of footwear.

In the manufacture of certain types of footwear the vamp is sewn to the upper or to an insert apron by turning the adjacent edges upwards and forming a seam on the outside of a slipper or shoe by thong stitching.

Thonging is a method of attaching or combining the edges of two or several sheets together of a variety of materials of either leather, plastic sheet or to other type of fabric.

The action of thonging by hand varies in difficulty in accordance with the materials used and the type of thonging thread used including leather, cotton, linen or other such fabric or plastic stitching media.

Regularly spaced holes are punched along the edges of the material and the difficulty is increased by the diminished size of the holes through which the attaching thread has to pass.

In the traditional method the objects to be thonged are held by hand and the thong thread is passed through the holes which have been perforated at various distances from the edges of the shoe pieces or sheets.

The hand method is rendered difficult if the parts of the object, e.g. the shoe or slipper, are being manufactured and thonged from stout or hard material, and in such a case often result in an irregular appearance, also in such cases the operation is slowed down resulting in greater expense in production due to the slower execution by the operator in performing the work.

According to the invention method for machine thong stitching in the manufacture of footwear comprises providing a barbed needle on a rod connected to a ram in a fluid operated cylinder, passing the needle through preformed pairs of shaped holes in material to be thong stitched, placing a thonging thread around the needle, applying fluid to one end of the cylinder to draw the needle and the thonging thread through the material, with drawing the free end of the thonging thread from the needle and moving the material to receive the needle, through a succeeding pair of holes in the material and applying fluid to the opposite side of the ram to re-pass the needle through the material for a succeeding stitch.

The invention further includes a machine for carrying out the foregoing method comprising a fluid operated cylinder with a ram therein, a casing in line with the cylinder and a rod extending from the ram through the casing and carrying a barbed needle for drawing the thong thread through the material at each stitch, a table or frame below which the cylinder is mounted, an air line to each side of the ram, a foot operated pedal and a control valve to direct the air into one or other end of the cylinder.

The invention will be described with reference to the accompanying drawings.

Figure 1:
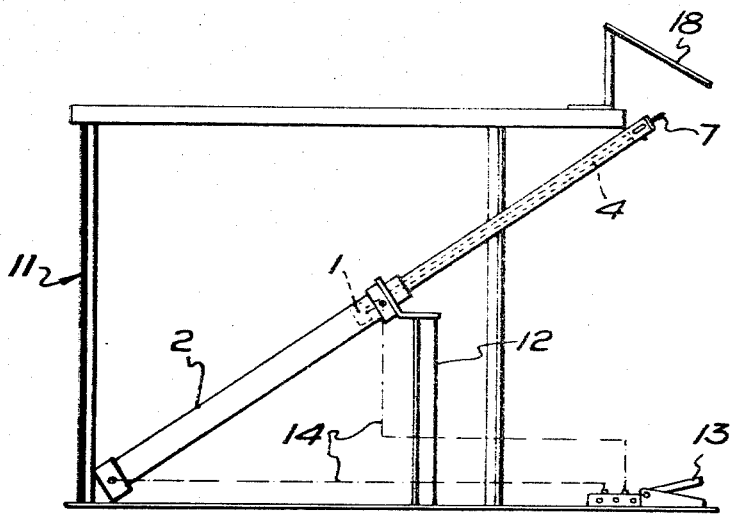
FIG. 1 is a side elevation of the machine.
Figure 2:
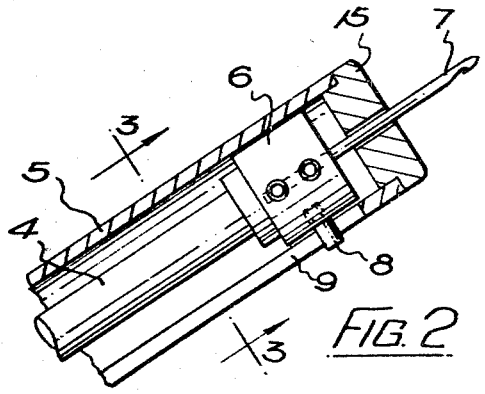
FIG. 2 is a detail section of the operating cylinder and needle.
Figure 3:
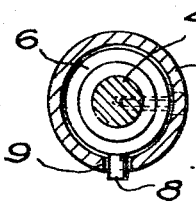
FIG. 3 is a section in line 3—3 FIG. 2.

In carrying out the method, the sheets or pieces to be thonged are placed in close juxtaposition. The two pieces or sheets are then placed over the barb of a needle protruding from the machine which is activated pneumatically, hydraulically or mechanically after the thonging thread has been placed over the barb of the needle. The needle on which the thong thread has been placed passes through the perforations as the operator activates a piston holding the needle and thread.

The method continues with the operator moving the material to be thonged from one perforated hole to the next perforated hole or any succession of perforation holes.

The strength of pull of the pneumatic or hydraulic cylinder or other mechanical or lever apparatus can be adjusted according to the tension required and can thus determine the even appearance of the thonged material.

Such a degree of regularity is most difficult to acquire in the hand method which is subject to greater irregularity as the material or shoe has to be held by one hand whilst the thonging thread has to be threaded and tension pulled by the other hand which tends to cause irregularity.

The machine method, besides giving a more regular result, is such quicker in performance particularly in the case of hard or stout materials of leather and other stiffer materials or threads.

The thonging needle in the new method draws the thread through the perforated holes by pneumatic, hydraulic or mechanical means.

A further advantage of the machine method lies in the fact that material to be thonged can be placed over the or around the needle using both hands simultaneously allowing the thonging thread to be fed under or around the barb of the needle.

This process of mechanical thonging is much speedier than the hand method and facilitates greater economy in production.

A thonging machine comprises a ram 1 mounted in a cylinder 2, a rod being connected to the ram 1 to extend out of one end of the cylinder containing the ram into a casing 5 acting as a guide for the rod 4. A head 6 is mounted on the free end of the rod 4 to which a barbed needle 7 is affixed, grub screws 8*a* being screwed into the head 6 to lock the needle. A guide pin 8 extends through a slot 9 in the casing 5 to prevent rotation of the needle during reproduction. The needle 7 projects through a cap 15 closing the end of the casing 5.

The cylinder 1 is mounted below a frame or table 11 on a bracket or support 12. The cylinder 1 is supplied with compressed air through a foot operated pedal 13 and air lines 14, controlling a valve to direct the air into one or other end of the cylinder.

The cylinder 2 is preferably mounted below the table 11 for receiving the work at an angle to the vertical, with the needle 7 when extended substantially on a level with the top of the table.

Figure 4:
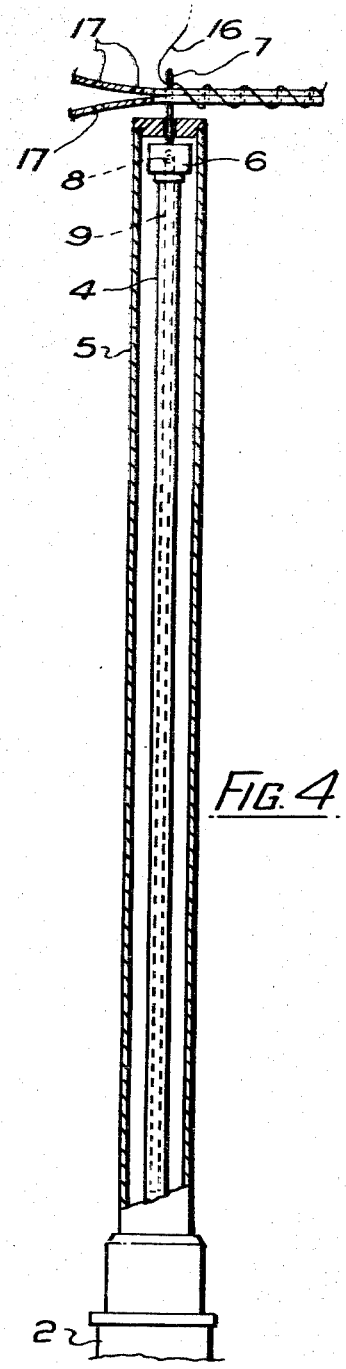
FIG. 4 is a longitudinal section through the cylinder showing the needle projecting through holes in the material to be thonged.
Figure 5:
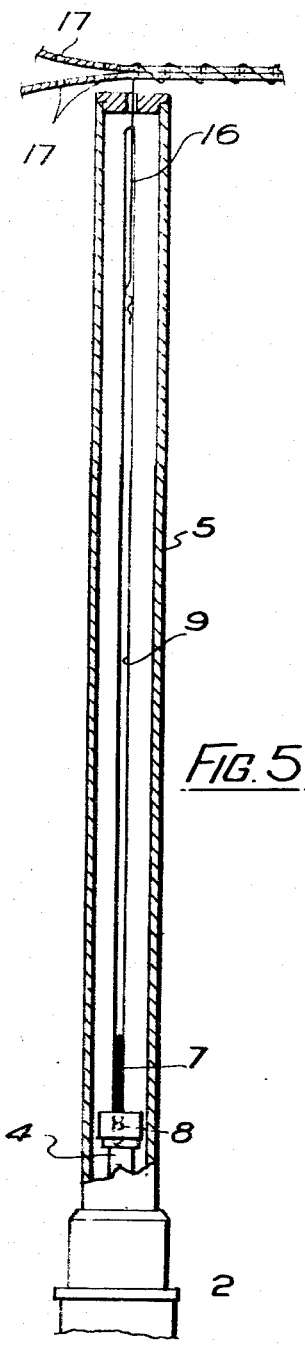
FIG. 5 is a similar section showing the needle withdrawn into the cylinder.

In operation the ram 1 is moved to the upper end of the cylinder 2 with the needle 7 projecting from the casing 5 and the operator inserts the material to be stitched to which a thread has been attached, onto the needle and wraps the thread 16 around the needle 7 as shown in FIG. 4. The ram 1 is then operated by the pedal 13 to withdraw the needle 7 into the casing 5 thus drawing the thread 16 through the holes 17 in the material. The thread 16 passes through the material as the needle 7 passes down the facing 5 and applies a tension to the thread or thong and is finally drawn off needle and at the end of the stroke the free end of the thread is withdrawn by the operator from the casing 5 for a succeeding stitch.

A guard 18 of a transparent plastics material is mounted on the table 11 above the needle 7 which normally projects from the casing 5 and is withdrawn by depressing the pedal 13 and returns to the normal position on release of the pressure on the pedal.

The needle 7 is again extended through the casing 5 and the next pair of holes 17 in the material are inserted thereon and the operations repeated until the seam is completed.

For double or cross thread thonging the material is threaded onto the needle 7 as before and a second stitch is inserted through each of the holes in turn, the thonging terminating where it originally started.

The tension applied to the thread at each stitch is uniform and does not vary from operator to operator and accordingly the material is not puckered and the finished shoes or slippers are therefore more regular in appearance.

What I claim is:

1. Apparatus for thong stitching in the manufacture of footwear comprising a support upon which are placed two of the footwear components each having a series of prepunched holes in superposition with a hole in one component aligned with a corresponding hole in the other component, said support being constructed and arranged to locate said components in a station in substantially horizontal relation, a power driven reciprocable barbed needle at said station disposed in alignment with said aligned holes, means for operating the power drive for said needle to pass the needle through said aligned holes, the free end of a thonging thread attached at the other end to one of the components being placed on the end of the needle that has passed through the components, and means for operating the power drive for the needle in reverse to draw the needle and the free end of the thread through said aligned holes, said needle being slidably mounted and guided in a hollow casing on said support and being mounted on a piston rod that projects through said casing from a pneumatic cylinder mounted on the support to extend at an angle to the vertical toward said station, and said piston having a stroke whereby when displaced in one direction it projects the needle through the end of the casing into the aligned component holes and when displaced in the other direction it may draw the needle entirely back into the casing carrying the thread under tension.

2. The apparatus defined in claim 1, wherein said cylinder is a double ended pneumatic cylinder.

3. The apparatus defined in claim 1, wherein said cylinder is mounted below said station, said piston rod extends through a hollow casing fixedly coaxial with the cylinder, and said needle is mounted on a head fixed on the piston rod and slidably guided along said casing.

* * * * *